US007331072B2

(12) United States Patent
Waldman et al.

(10) Patent No.: US 7,331,072 B2
(45) Date of Patent: Feb. 19, 2008

(54) CONVERTIBLE BED HAVING COMPONENTS SERVING MULTIPLE FUNCTIONS

(75) Inventors: Kenneth C. Waldman, Reading, PA (US); Jerome Drobinski, Reading, PA (US)

(73) Assignee: Simplicity, Inc., Reading, PA (US)

( * ) Notice: Subject to any disclaimer, the term of this patent is extended or adjusted under 35 U.S.C. 154(b) by 0 days.

(21) Appl. No.: 10/875,939

(22) Filed: Jun. 24, 2004

(65) Prior Publication Data

US 2005/0005352 A1 Jan. 13, 2005

Related U.S. Application Data

(60) Provisional application No. 60/482,332, filed on Jun. 25, 2003.

(51) Int. Cl.
*A47D 7/09* (2006.01)

(52) U.S. Cl. ..... 5/93.2; 5/2.1

(58) Field of Classification Search ..... 5/2.1, 5/93.1, 93.2, 97, 100
See application file for complete search history.

(56) References Cited

U.S. PATENT DOCUMENTS 5,077,846 A * 1/1992 Wheeler et al. ..... 5/93.2

* cited by examiner

*Primary Examiner*—Carlos Lugo
*Assistant Examiner*—Fredrick Conley
(74) *Attorney, Agent, or Firm*—Volpe and Koenig, P.C.

(57) ABSTRACT

A bed assembly convertible from a crib to a toddler bed to a full size headboard or vice versa. Components of the bed assembly perform multiple, different functions in each of the bed arrangements. For example, the component which functions as a sidewall in the crib structure is utilized as part of the toddler bed and full size headboard, together with tubular elements forming part of the crib mattress support which serve as components of the headboard for the full size bed.

53 Claims, 5 Drawing Sheets

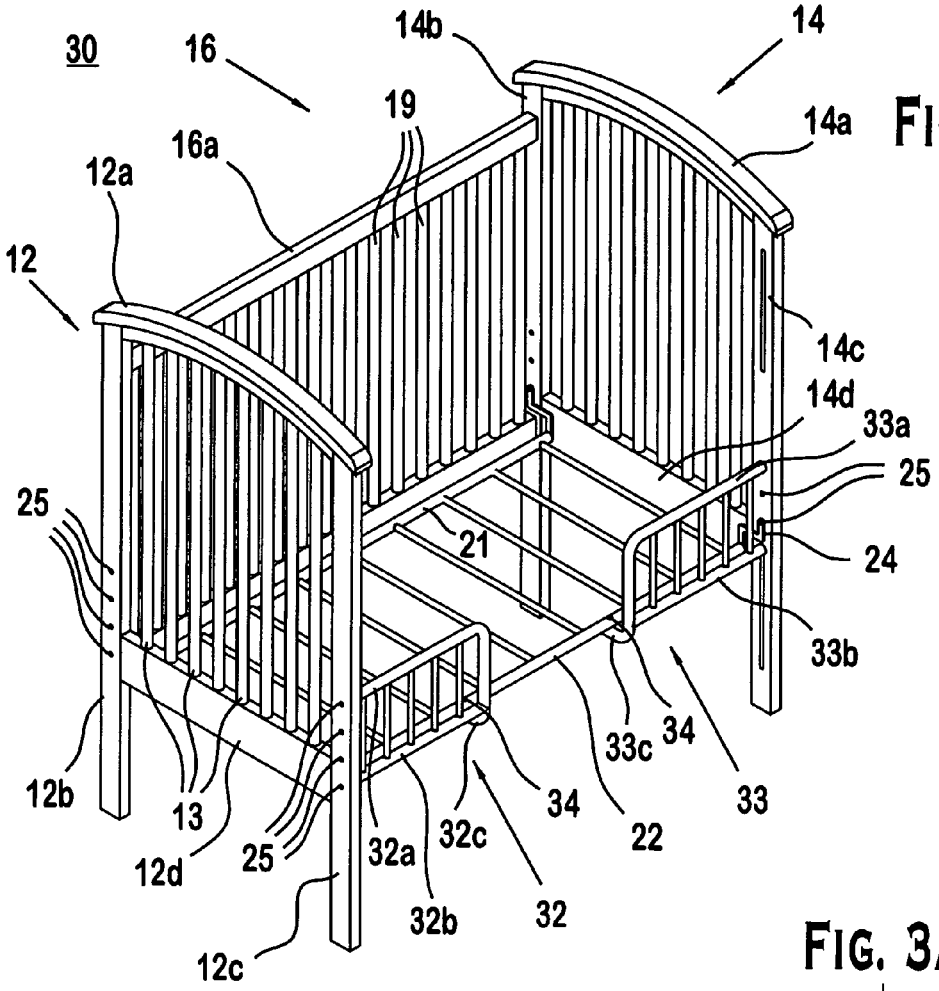
FIG. 3
FIG. 3A
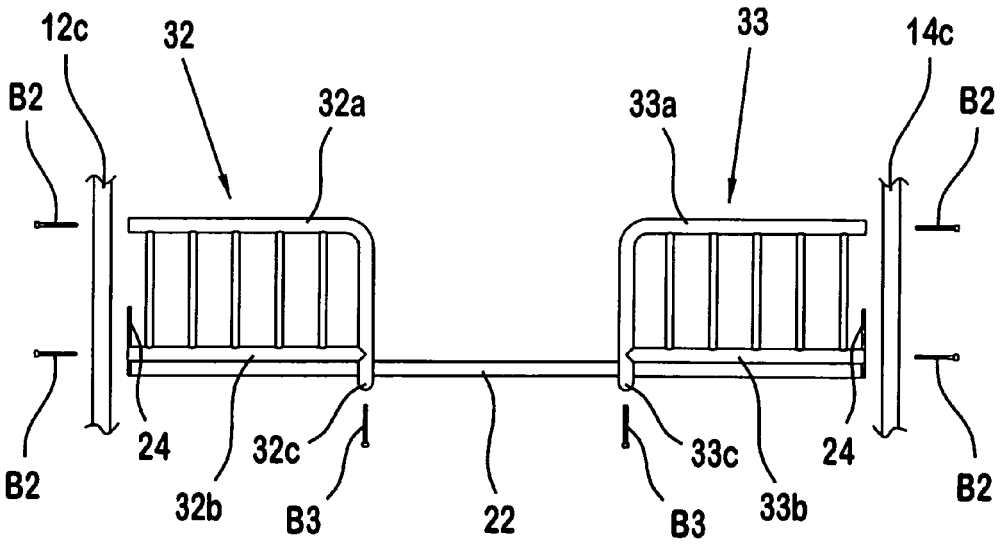

CONVERTIBLE BED HAVING COMPONENTS SERVING MULTIPLE FUNCTIONS

CROSS REFERENCE TO RELATED APPLICATION

This application claims the benefit of U.S. Provisional Application No. 60/482,332, filed on Jun. 25, 2003, which is incorporated herein by reference as if fully set forth.

FIELD OF THE INVENTION

The present invention relates to a bed assembly convertible from a crib to a toddler bed to a full size headboard and vice versa and more particularly to a bed assembly in which components thereof serve different and multiple functions in different ones of the possible bed structures.

BACKGROUND

Convertible bed assemblies are well known and have the capability of "growing" with the growth of an infant, i.e., of being capable of being assembled to form a crib and being convertible from a crib to a toddler bed and ultimately to a full size headboard thereby "growing" along with an infant. One such convertible bed assembly is described in U.S. Pat. No. 5,146,631, granted Sep. 15, 1992. Although the conversion capabilities of the aforementioned patent are commendable, it is nevertheless desirable to provide a convertible bed assembly of simplified design and one in which fewer components are needed.

SUMMARY

The present invention provides a convertible bed assembly having a design which is rugged, simplified, easy to use and which, in addition to having a reduced number of components, utilizes components which perform multiple and different functions in the various bed structures.

BRIEF DESCRIPTION OF THE FIGURES

The present invention will be understood from a consideration of the Figures wherein like elements are designated by like numerals and wherein:

FIG. 3 is a perspective view of an assembled toddler bed employing the components of the convertible assembly of the present invention.

FIG. 3A is a detailed view of the safety rails employed in the toddler bed of FIG. 3.

DETAILED DESCRIPTION OF THE PREFERRED EMBODIMENTS

Figure 1:
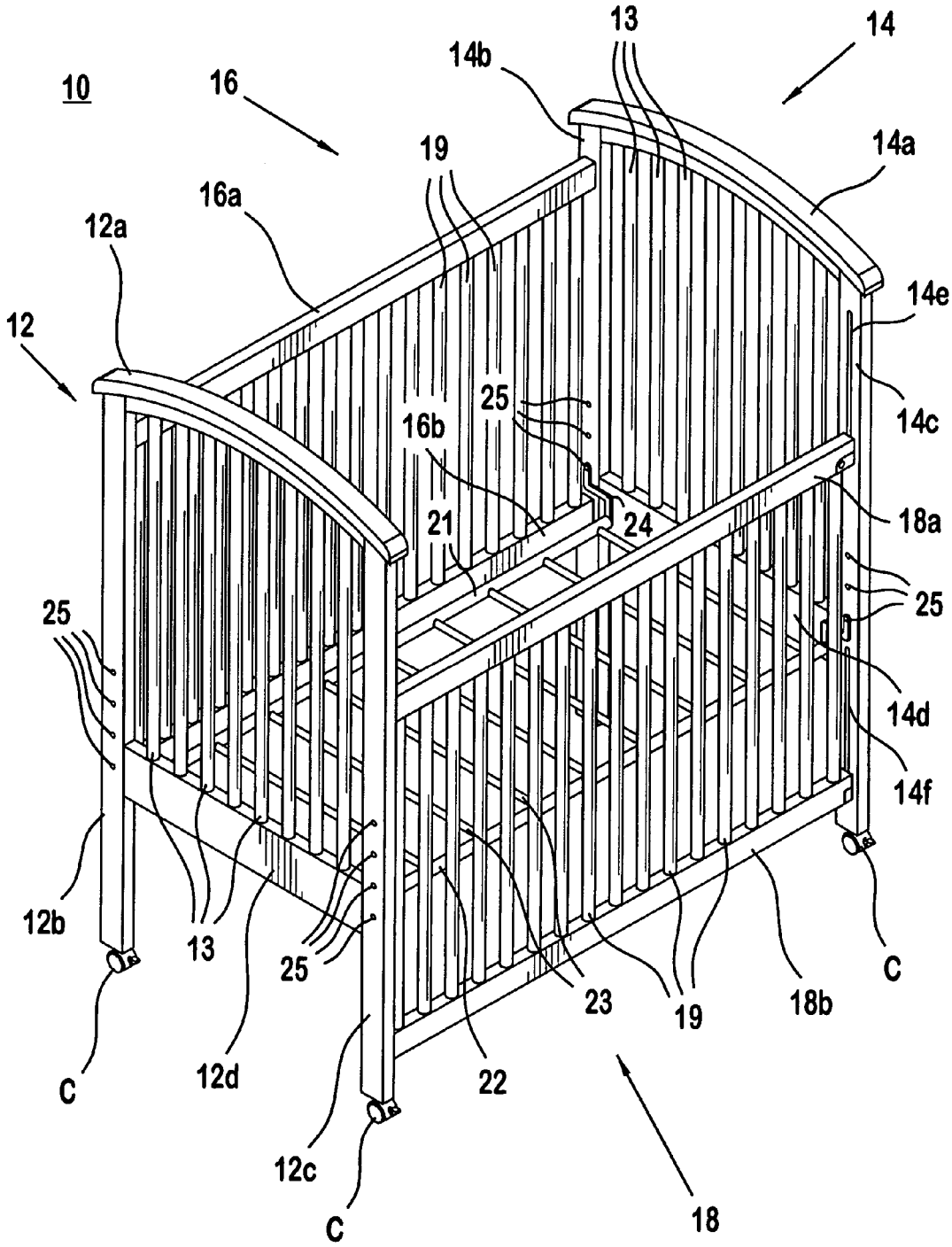
FIG. 1 is a perspective view of a crib structure embodying the principles of the present invention.

Certain terminology is used in the following description for convenience only and is not limiting. The words "right," "left," "lower," "upper," "top," and "bottom" designate directions in the drawings to which reference is made. The terminology includes the words noted above as well as derivatives thereof and words of similar import.

The crib structure 10, shown in FIG. 1, is comprised of two endboards 12 and 14, one of which functions as a headboard and the other of which functions as a footboard, and stationary and moveable sides 16 and 18 respectively. The movable side 18 (typically referred to as a drop side) is capable of being raised and lowered to facilitate placement and removal of an infant.

The endboards 12 and 14 are preferably substantially identical in design and function. The endboards 12 and 14 each preferably have a curved upper member 12*a*, 14*a* and a lower member 12*d*, 14*d* with two end posts 12*b*, 12*c* and 14*b*, 14*c*; the lower ends of which are typically provided with either a rubber foot or a selectively lockable caster C. A plurality of slats 13 are arranged in spaced parallel fashion and have their upper ends secured to members 12*a*, 14*a* and their lower ends secured to members 12*d*, 14*d* of endboards 12, 14, respectively.

Similarly, the stationary and drop sides 16 and 18 are preferably substantially identical in design and function. Stationary and drop sides 16, 18 each have an upper rail 16*a*, 18*a* and a lower rail 16*b*, 18*b* and a plurality of slats 19 arranged in spaced parallel fashion and having their upper ends secured to upper rails 16*a*, 18*a* and their lower ends secured to lower rails 16*b*, 18*b*.

The hardware utilized to connect the stationary and drop sides 16 and 18 is conventional and will be omitted herein for purposes of simplicity, it being understood that a set of upper and lower tracks 14*e*, 14*f* (only one set of upper and lower tracks being shown) are preferably provided in end posts 12*c* and 14*c* and cooperate with such conventional hardware for lifting and lowering the drop side 16.

Figure 2:
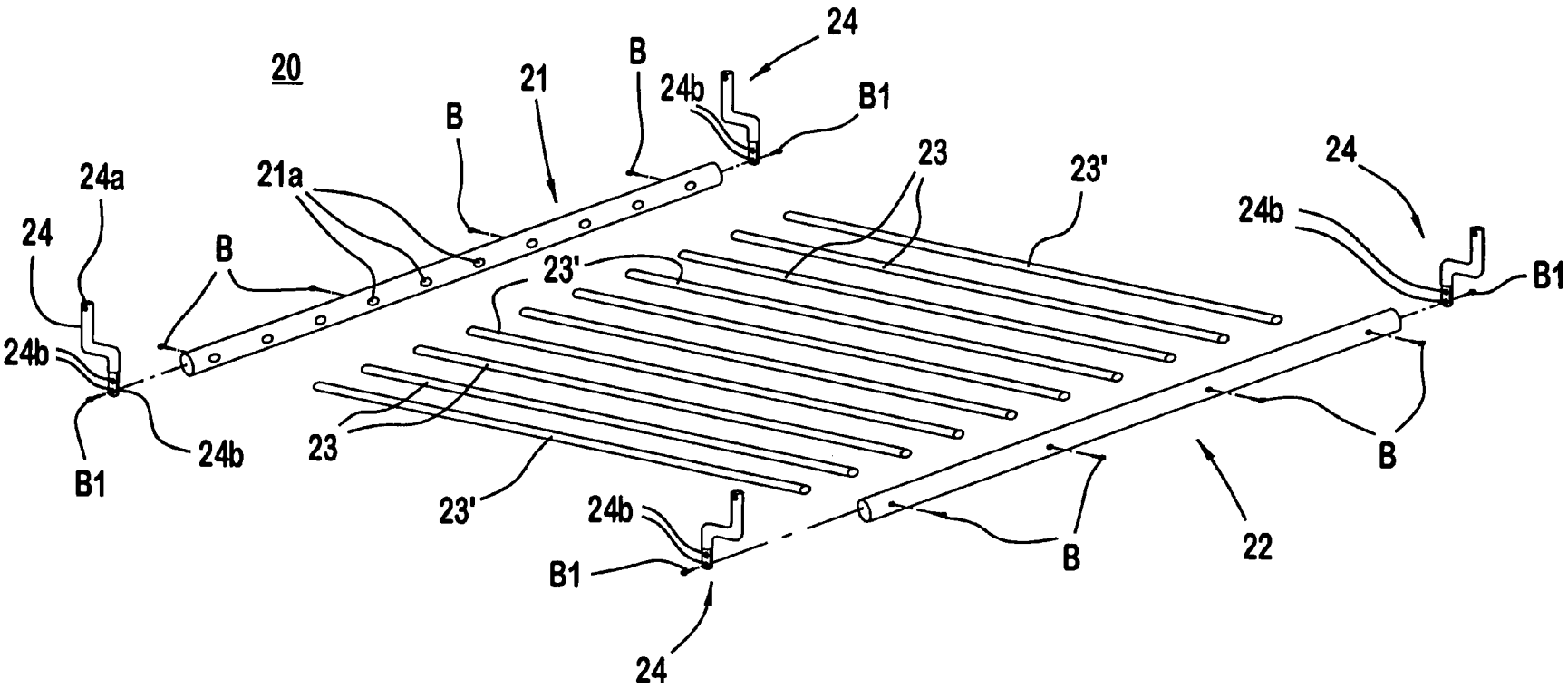
FIG. 2 is an exploded perspective view of the mattress support for the crib shown in FIG. 1.

A mattress support assembly 20 is shown in assembled fashion in FIG. 1 and in an exploded view in FIG. 2. FIG. 2 is a perspective, exploded view showing the mattress support assembly 20 which is comprised of support posts 21, 22 and a plurality of substantially identical crossbars 23, each arranged to extend into cooperating openings in the support posts 21 and 22. Note, for example, the openings 21*a* in support post 21; support post 22 being provided with similar openings (not shown). Only selected ones 23' of the crossbars 23 need be secured at both ends to the support posts 21 and 22 by suitable assembly bolts B, the remaining crossbars 23 being retained in place by securement of the crossbars 23' with the support posts 21 and 22 by way of the assembly bolts B.

Four (4) S-shaped brackets 24 have their lower ends coupled to the support posts 21 and 22. The upper end of each S-shaped bracket is provided with an opening 24*a* for securement to an associated one of the end posts 12*b*, 12*c*, 14*b*, 14*c*. The lower ends are provided with a plurality of spaced openings 24*b* and receive an assembly bolt B1 in one of these openings 24*b* for securement to an end of an associated support post 21, 22. The S-shaped configuration prevents interference between these brackets and the drop and stationary sides 18, 16.

The mattress support assembly 20 may be raised or lowered relative to end posts 12*b*, 12*c*, 14*b*, 14*c* by selection of the appropriate one of the group of openings 25 on end posts 12*b*, 12*c*, 14*b*, 14*c* and/or by selection of one of the plurality of openings 24*b* on the S-shaped members.

The crib 10 may be converted to a toddler bed 30, shown in FIG. 3 by removal of the drop side 18 and its associated hardware. The casters C (see FIG. 1) are also preferably removed and replaced by suitable end caps (not shown for purposes of simplicity) which snap fit into the bottoms of the end posts 12*b*, 12*c*, 14*b*, 14*c*. A pair of safety rails 32, 33 have their left-hand and right-hand ends respectively secured to the posts 12*b*, 14*b* by suitable assembly bolts B2 extending through openings 25 in the end posts 12*b*, 12*c*, 14*b*, 14*c* and threadedly engaging a suitable tapped member (not shown for purposes of simplicity) in the ends of horizontal members 32*a*, 32*b* and 33*a*, 33*b* of safety rails 32 and 33 as shown in FIG. 3A. Each of the safety rails 32, 33 is further secured to the mattress support post 22 by suitable assembly bolts B3 extending through openings 34 in the mattress support post 22 and corresponding openings (not shown) in inwardly directed sections 32*c*, 33*c* of the bottom of safety rails 32, 33 as shown in FIGS. 3 and 3A.

Figure 4:
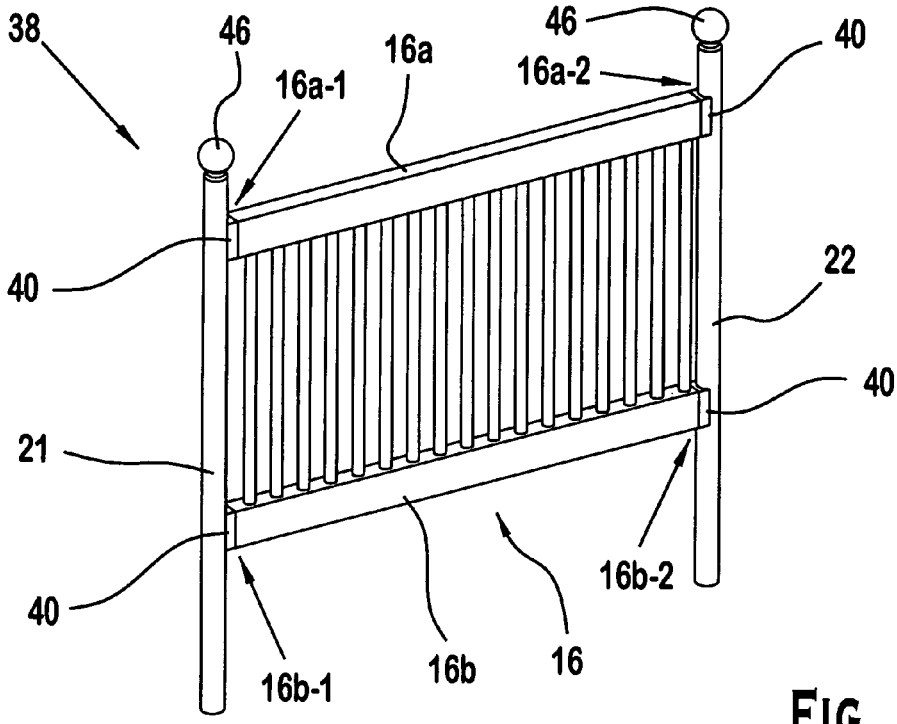
FIG. 4 is a perspective view of a full size headboard assembled from selected components of the convertible assembly.
Figure 4A:
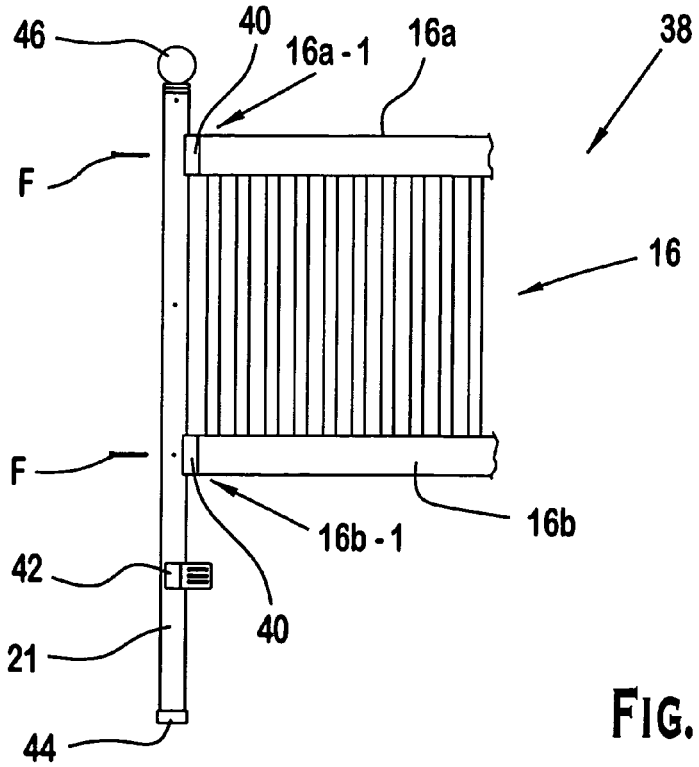
FIG. 4A is a detailed view showing a section of the headboard of FIG. 4 in greater detail.
Figure 4B:
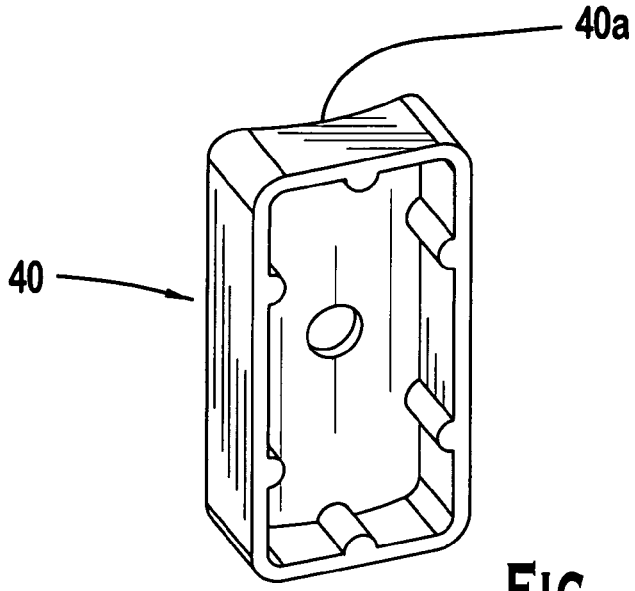
FIGS. 4B and 4C are detailed views of selected ones of the components employed in the full size headboard assembly of FIG. 4A.
Figure 4C:
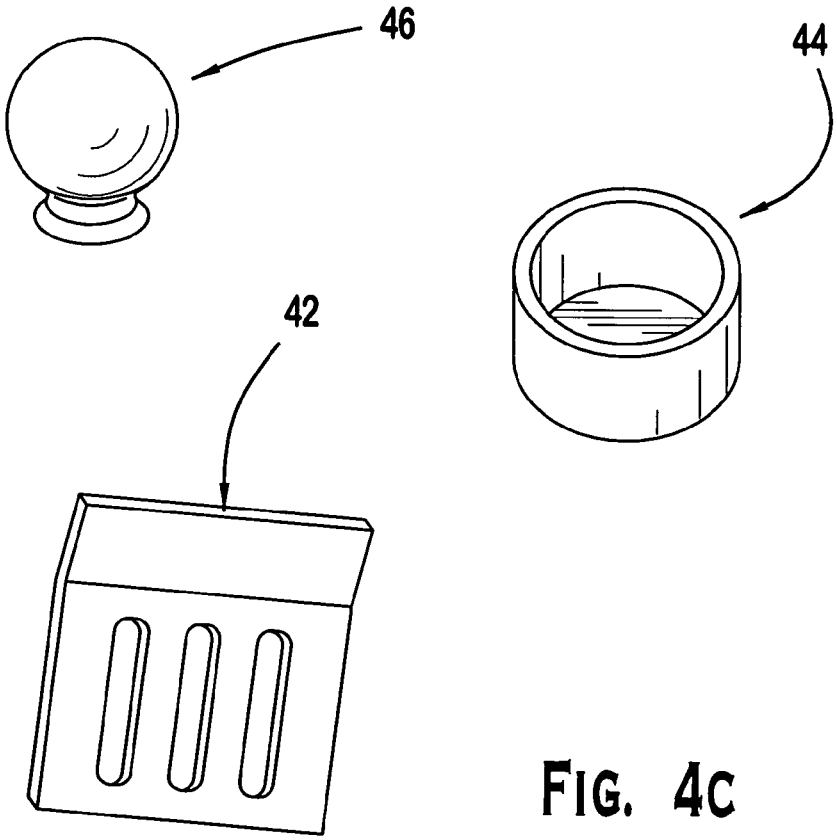

The crib 10 or toddler bed 30 may further be converted into a full size headboard through utilization of the stationary side 16 and the support posts 21 and 22 of the mattress support assembly 20 (see FIG. 2). The mattress support assembly 20 is disassembled and the two support posts 21 and 22 are then employed, together with the stationary side 16 to form a headboard 38 for a full size bed. FIG. 4 shows the full size headboard 38 while FIG. 4A shows the manner in which the full size headboard 38 is assembled by disassembling the crib 10 shown in FIG. 1, or, as the case may be, the toddler bed 30 shown in FIG. 3, in order to preferably utilize the stationary side 16 and the support posts 21 and 22. Making reference to FIGS. 4, 4A, and 4B, a connector 40 having a rounded end surface 40*a* is pushed onto each of the hollow ends 16*a*-1, 16*a*-2, 16*b*-1, 16*b*-2 of the upper and lower rails 16*a* and 16*b*. Alternatively, an end cap (not shown) can be mounted upon each end 16*a*-1, 16*a*-2, 16*b*-1, 16*b*-2 of the upper and lower rails 16*a*, 16*b* and secured to the support posts 21, 22 and upper and lower rails 16*a*, 16*b* by suitable screw fasteners (not shown). The support posts 21, 22 are preferably positioned to be adjacent to opposing ends of the stationary side 16. A bed frame attachment 42, also shown in detail in FIG. 4C, is attached to each of the support posts 21, 22 at the position shown in FIG. 4A (only one side being shown). A cylindrical-shaped end cap 44 can be placed over the bottom end of each of the support posts 21, 22.

Fasteners F are passed through support posts 21 and 22 and the connectors 40 and engage tapped openings within the interior of the upper and lower side rails 16*a*, 16*b*. The connectors 40, one being shown in FIG. 4B, each have a curved concave surface 40*a* confronting the support posts 21, 22 which conforms to the convex curvature of the support posts 21, 22

A decorative ball-shaped member 46 is mounted at the top of the support posts 21, 22. The decorative ball 46 is preferably snap-fitted into position.

The bed frame attachments 42, which are provided on each of the support posts 21 and 22, can be adjusted up or down on the support posts 21, 22. A standard bed rail (not shown) may be utilized, as is conventional, and secured to the bed frame attachments 42.

The unused components are normally stored for future use and the full size headboard may be converted back to either a toddler bed 30 or crib 10.

The arrangement shown herein while being capable of being assembled to provide any one of a crib, toddler bed or full size headboard, significantly reduces the number of components required due to the novel design in which a number of the components of the convertible bed assembly are designed to perform a plurality of different functions according to the type of bed being assembled. The components may be tubular metallic or plastic members or may be solid members made of assembled plastic or wood.

While various methods, configurations, and features of the present invention have been described above and shown in the drawings for the various embodiments of the present invention, those of ordinary skill in the art will appreciate from this disclosure that any combination of the above features can be used without departing from the scope of the present invention. Accordingly, it is recognized by those skilled in the art that changes may be made to the above described methods and embodiments of the invention without departing from the broad inventive concept thereof. It is understood, therefore, that this invention is not limited to the particular methods and embodiments disclosed, but is intended to cover all modifications which are within the spirit and scope of the invention as defined by the appended claims and/or shown in the attached drawings.

What is claimed is:

1. A convertible bed assembly, comprising:

a crib assembly, said crib assembly comprising:

a pair of end assemblies;

first and second crib sides, each crib side being coupled to said end assemblies;

a mattress support assembly comprising a pair of elongated support members and a plurality of cross pieces releasably secured to said elongated support members and arranged in a spaced parallel fashion and aligned transverse to the elongated support members; and said elongated support members being coupled to said end assemblies; wherein one of said first and second crib sides and said elongated support members are configured to form a full size headboard when one of said first and second crib sides and said elongated support members are separated from the crib assembly and said elongated support members are secured to opposite ends of said one of said first and second crib sides.

2. The apparatus of claim 1, wherein the full size headboard further comprises a bed frame attachment assembly mounted at a lower end of each said support member.

3. The apparatus of claim 1, wherein the full size headboard further comprises a decorative member fitted at an upper end of each said support member.

4. The apparatus of claim 3, wherein said decorative members are ball-shaped.

5. The apparatus of claim 1, wherein one of said first and second crib sides is disassembled from the crib assembly and a pair of side safety rails are mounted to each of said end assemblies and to one of said elongated support members, said side safety rails being of a length to provide a gap between adjacent ends thereof.

6. The apparatus of claim 5, wherein the gap formed between said adjacent ends of said side safety rails is of such length to enable a toddler to climb in and out of the crib assembly while providing protection against a toddler from rolling out of the crib assembly.

7. The apparatus of claim 1, wherein said end assemblies are each comprised of pair of end posts.

8. The apparatus of claim 7, wherein said end assemblies are further comprised of a pair of spaced cross members coupled to said end posts and a plurality of slats arranged in spaced parallel fashion and having their upper ends secured to an upper one of said cross members and having their lower ends secured to a lower one of said cross members.

9. The apparatus of claim 7, wherein said support members are coupled to said end posts.

10. The apparatus of claim 9, wherein said support members are coupled to said end posts by S-shaped coupling links secured at their upper ends to the end posts by first fasteners and secured at their lower ends to an end of one said support members by second fasteners.

11. The apparatus of claim 10, wherein said S-shaped support brackets are provided with a plurality of openings at one end thereof to enable adjustment of a height of the mattress support assembly relative to said crib sides.

12. The apparatus of claim 10, wherein said end posts are provided with a plurality of openings to enable adjustment of a height of the mattress support assembly relative to said crib sides.

13. The apparatus of claim 7, wherein said first and second crib sides are coupled to said end posts.

14. The apparatus of claim 13, wherein one end post of each of said end assemblies includes a set of upper and lower tracks to slidably engage of one of said first and second crib sides.

15. The apparatus of claim 1 wherein said first and second sides are comprised of upper and lower rails and a plurality of slats arranged in spaced parallel fashion and having their upper ends coupled to the upper rail and their lower ends coupled to the lower rail.

16. The apparatus of claim 15, further comprising connectors provided for mounting between each said support member and each end of the upper and lower rails of said one of said first and second crib sides when the apparatus is in the full size headboard configuration, the connectors having a concave surface conforming to a curvature of said support posts and engaging said support posts.

17. The apparatus of claim 16, wherein the ends of the upper and lower rails are positioned in engagement with said support posts; and fastening means securing the support posts to opposite ends of the upper and lower rails.

18. The apparatus of claim 1, wherein said support members are provided with end caps on bottom ends thereof when the apparatus is in the full size headboard configuration.

19. The apparatus of claim 1, wherein the end assemblies each include a pair of leg members, the bottom of each of the leg members having a caster or end cap secured thereto.

20. A method for selectively erecting one of a crib assembly, toddler bed, and a full size headboard from a set including first and second crib sides, first and second crib ends, and a mattress support assembly including first and second support members and a plurality of cross members releasably joined to the support members at spaced locations along and inward from the ends of said support members, said method comprising:

securing said first and second crib sides and said mattress support assembly to said first and second crib ends to erect the crib assembly;

disassembling one of said first and second crib sides from the crib assembly and mounting a pair of safety rails to each of said end assemblies and to the mattress support member to erect the toddler bed; and disassembling one of said first and second crib sides and said elongated support members from the crib assembly and securing said elongated support members to opposite ends of said one of said first and second crib sides to erect the full size headboard and to form vertical posts of said headboard.

21. A method of utilizing a group of components for constructing one of a plurality of bed configurations comprising:

providing a support structure designed to support a mattress and comprised of a pair of elongated side members and a plurality of cross-pieces releaseably joined to the support members at spaced locations along and inward from the ends of said support members;

providing a side support designed for use as a crib side of a crib and comprised of upper and lower rails and a plurality of spaced parallel slats joined to said upper and lower rails; and joining said each of said elongated side members to opposite ends of said upper and lower rails to form a headboard for an adult bed.

22. The method of claim 21, further comprising:

mounting a bed rail support to lower ends of said elongated side members for supporting a bed rail.

23. The method of claim 21, further comprising:

mounting top members to top ends of said elongated side members to enhance the aesthetic appearance of said headboard.

24. A method of utilizing a group of components for constructing one of a plurality of bed configurations comprising:

providing a support structure designed to support a mattress and comprised of a pair of elongated side members and a plurality of cross-pieces;

providing a side support designed for use as a crib side of a crib and comprised of upper and lower rails and a plurality of spaced parallel slats joined to said upper and lower rails; and joining said each of said elongated side members to opposite ends of said upper and lower rails to form a headboard for an adult bed, wherein said elongated side members have a given cross-sectional shape, said method further comprising:

providing mating connectors having mating surfaces conforming to the shape of the elongated side members;

placing the mating connectors between each elongated side member and each end of the upper and lower rails so that the connector mating surfaces engage the elongated side members and portions of the connectors opposite the mating surfaces engage said upper and lower rails; and securing the elongated side members to the upper and lower rails with fastening members.

25. The method of claim 21, further comprising placing end caps on bottom ends of said elongated side members to provide suitable support for said headboard.

26. A convertible bed kit, comprising:

a pair of crib ends, first and second crib sides, a pair of elongated support members, a plurality of cross-pieces, toddler safety sides, and a bed rail;

wherein said pair of crib ends, said first and second crib sides, said pair of elongated support members, and said plurality of cross-pieces of said kit are releasably combined to form a crib;

said pair of crib ends, one of said first and second crib sides, said pair of elongated support members, said plurality of cross-pieces, and said toddler safety sides are releasably combined to form a toddler bed; and one of said crib sides and said elongated support members are releasably combined to form a headboard for an adult bed;

said one crib side and said elongated support members serving different functions in at least two of said combinations and said elongated members being horizontally aligned to form said crib and said toddler bed and being vertically aligned to form said headboard.

27. The convertible bed kit of claim 26, wherein each of said crib sides are coupled to each of said crib ends, said plurality of cross-pieces are secured to said horizontally aligned elongated support members, and said elongated support members coupled to said crib ends when selected components of the convertible bed kit are combined to form the crib.

28. The convertible bed kit of claim 26, wherein one of said first and second crib sides is coupled to each of said crib ends, at least some of said plurality of cross-pieces are secured to said elongated support members, and said horizontally aligned elongated support members are coupled to said crib ends when selected components of the convertible bed kit are combined to form the toddler bed.

29. The convertible bed kit of claim 28, wherein each of said toddler safety sides are mounted to selected ones of said crib ends and to one of said horizontally aligned elongated support members when selected components of the convertible bed kit are combined to form the toddler bed.

30. The convertible bed kit of claim 26, wherein said elongated support members are horizontally aligned and secured to opposite ends of said one of said first and second crib sides when selected ones of the convertible bed kit are combined to form the headboard for an adult bed.

31. The convertible bed kit of claim 30, wherein bed frame attachments are mounted at a lower end of each of said horizontally aligned elongated support members when the elongated support members are employed to form the headboard for an adult bed.

32. The convertible bed kit of claim 30, wherein top members are mounted on top ends of said vertically aligned elongated support members to enhance an aesthetic appearance of the elongated support members when selected ones of the convertible bed kit are combined to form a headboard for an adult bed.

33. The convertible bed kit of claim 30, wherein mating connectors are mounted between the elongated support members and said one crib side and are each provided with at least one concave mounting surface to mate with a convex surface of said elongated members to compensate for dissimilar shapes of the mating surfaces of said elongated support members and said one crib side when the said one crib side and said elongated support members are combined to form the headboard for an adult bed.

34. The convertible bed kit of claim 30, wherein mating connectors are mounted between the elongated support members and said one crib side to compensate for dissimilar shapes of the mating surfaces of said vertically aligned elongated support members and said one crib side when the said one crib side and said elongated support members are combined to form the headboard for an adult bed.

35. A kit of interchangeable components, comprising first and second crib sides each having upper and lower rails;

a mattress support assembly having first and second long support posts and a plurality of cross pieces;

said long support posts having openings inwardly from their ends for receiving a first plurality of fasteners to releaseably secure the ends of at least one of the cross-pieces to said long support posts and maintain the cross pieces in spaced-parallel fashion and also maintain the long support posts in spaced-parallel fashion;

said first and second long support posts having openings to respectively releaseably join said first and second long support posts to opposite ends of said upper and lower rails of said one of said crib sides with a second plurality of fasteners to form a head board for an adult bed and thereby to serve as an integral part of the crib mattress support for a crib and as corner posts for an adult bed head board and said one of said crib side serves as one side of a crib and as part of a head board.

36. The kit of claim 35 wherein the ends of said upper and lower rails are provided with openings for receiving said second plurality of fasteners to respectively join said first and second long support posts to said upper and lower rails.

37. The kit of claim 35, further comprising: end caps configured to be snap-fittingly mounted upon one end of each of said long support posts when the long support posts are joined to said upper and lower rails.

38. The kit of claim 35, further comprising:

wheel assemblies configured to be snap-fittingly mounted to a remaining end of each of said long support posts when the long support posts are joined to said upper and lower rails.

39. The kit of claim 35, further comprising:

feet configured to be snap-fittingly mounted to a remaining end of each of said long support posts when the long support posts are joined to said upper and lower rails.

40. The kit of claim 35, further comprising:

said long support posts each having curved convex peripheries; and a plurality of connectors each arranged between ends of the upper and lower rails and one of said long support posts and secured in position by said second plurality of fasteners and having curved concave surfaces engaging the curved convex surfaces of an associated one of said long support sides and conforming to the curved convex surfaces.

41. The kit of claim 40, wherein the ends of said upper and lower rails each have openings for threadedly engaging the second plurality of fasteners used to join the long support posts to said upper and lower rails.

42. The kit of claim 35, further comprising:

bed frame attachments are releaseably joined to said long support posts for releaseably coupling an adult bed frame to the head board.

43. A convertible bed assembly, comprising:

a crib assembly, said crib assembly comprising:

a pair of end assemblies;

first and second crib sides, each crib side being coupled to said end assemblies;

a mattress support assembly comprising a pair of elongated support members and a plurality of cross pieces releasably secured to said elongated support members and arranged in a spaced parallel fashion and aligned transverse to the elongated support members; and said elongated support members being coupled to said end assemblies; wherein one of said first and second crib sides and said elongated support members is configured to form a full size headboard when said one of said first and second crib sides is separated from the crib assembly and provided with a bed frame attachment assembly.

44. The apparatus of claim 43, wherein said end assemblies are each comprised of pair of end posts, said support members being coupled to said end posts by S-shaped coupling links secured at their upper ends to the end posts by first fasteners and secured at their lower ends to an end of one said support members by second fasteners.

45. The apparatus of claim 44, wherein said end posts are provided with a plurality of openings to enable adjustment of a height of the mattress support assembly relative to said crib sides.

46. A method for selectively erecting one of a crib assembly, toddler bed, and a full size headboard from a set including first and second crib sides, first and second crib ends, and a mattress support assembly including first and second support members and a plurality of cross members releasably joined to the support members at spaced locations along and inward from the ends of said support members, said method comprising:

securing said first and second crib sides and said mattress support assembly to said first and second crib ends to erect the crib assembly;

disassembling one of said first and second crib sides from the crib assembly to erect the toddler bed; and disassembling one of said first and second crib sides and said elongated support members for use as a headboard of an adult bed and combining a bed frame attachment with said one of said first and second crib sides for supporting a mattress.

47. A reconfigurable bed kit, comprising:

a pair of crib ends, crib sides, elongated support members, a plurality of cross-pieces, and a pair of bed frame adapters;

said pair of crib ends, crib sides, elongated support members, and said plurality of cross-pieces being dimensioned and configured to be releasably combined to form a crib;

said pair of crib ends, one of said crib sides, said pair of elongated support members and said plurality of cross-pieces being dimensioned and configured to be releasably combined to form a toddler bed;

said elongated support members and cross pieces being releasably joined and horizontally aligned to support a mattress for the crib and toddler bed; and one of said crib sides and said bed frame adapters being dimensioned and configured to be releasably combined to form a headboard for an adult bed;

whereby said one crib side serves different functions in at least two of said combinations.

48. The bed kit of claim 47, wherein toddler safety sides are mounted to selected ones of said crib ends and to one of said horizontally aligned elongated support members when selected components of the convertible bed kit are combined to form the toddler bed.

49. The bed assembly of claim 47, wherein the elongated support members are horizontally aligned and releasably joined to the crib ends to form one of said crib and toddler bed.

50. A convertible bed assembly, comprising:

a crib assembly, said crib assembly comprising:

a pair of end assemblies;

a pair of crib sides, each crib side being coupled to said end assemblies;

a mattress support assembly comprising a pair of elongated support members and a plurality of cross pieces releasably secured to said elongated support members and arranged in a spaced parallel fashion and aligned transverse to the elongated support members; and said elongated support members being independent of the crib sides and coupled to said end assemblies;

wherein one of said pair of crib sides is configured to form a headboard for an adult bed when said one of said crib sides is separated from the crib assembly and combined bed frame adapters for supporting a mattress.

51. The bed assembly of claim 50, further comprising height adjustment members for releasably joining the elongated support members to the end assemblies, the adjustable support members being configured to adjust a height of the elongated support members relative to the end assemblies.

52. A reconfigurable bed kit comprising:

a pair of crib ends, crib sides, elongated support members, a plurality of cross-pieces, and a pair of bed frame adapters;

said pair of crib ends, crib sides, elongated support members and plurality of cross-pieces being dimensioned and configured to be releaseably combined to form a crib;

said pair of crib ends, one of said crib sides, said pair of elongated support members and said plurality of cross-pieces being dimensioned and configured to be releasably combined to form a toddler bed;

said elongated support members and cross pieces being releasably joined and horizontally aligned to support a mattress for the crib and toddler bed; and one of said crib sides and said bed frame adapters being dimensioned and configured to be releasably combined to form a headboard for an adult bed;

whereby said one crib side serves different functions in at least two of said combinations.

53. The convertible bed assembly of claim 52, further comprising:

connecting members for coupling the ends of said elongated members to said end assemblies for adjusting a height of the mattress support assembly.

* * * * *